US005281754A

United States Patent [19]

Farrett et al.

[11] Patent Number: 5,281,754

[45] Date of Patent: Jan. 25, 1994

[54] MELODY COMPOSER AND ARRANGER

[75] Inventors: Peter W. Farrett; Daniel J. Moore, both of Austin, Tex.

[73] Assignee: International Business Machines Corporation, Armonk, N.Y.

[21] Appl. No.: 868,051

[22] Filed: Apr. 13, 1992

[51] Int. Cl.[5] ..... G10H 7/00; G04B 13/00; A63H 5/00

[52] U.S. Cl. ..... 84/609; 84/612; 84/615; 84/619; 84/645

[58] Field of Search ..... 84/600, 601, 645, 609, 84/610, 619, 649, 650, 657, 612, 615

[56] References Cited

U.S. PATENT DOCUMENTS

| | | | |
|---|---|---|---|
| 4,208,938 | 6/1980 | Kondo | 84/DIG. 12 X |
| 4,305,319 | 12/1981 | Linn | 84/611 |
| 4,399,731 | 8/1983 | Aoki | 84/1.03 |
| 4,483,230 | 11/1984 | Yamauchi | 84/1.03 |
| 4,682,526 | 7/1987 | Hall et al. | 84/613 |
| 4,708,046 | 11/1987 | Kozuki | 84/1.03 |
| 4,896,576 | 1/1990 | Ino | 84/634 |
| 4,926,737 | 5/1990 | Minamitaka | 84/613 X |
| 4,998,960 | 3/1991 | Rose et al. | 84/622 |
| 5,033,352 | 7/1991 | Kellogg et al. | 84/658 |
| 5,117,726 | 6/1992 | Lisle et al. | 84/645 X |

OTHER PUBLICATIONS

*Current Directions in Computer Music Research*, MIT Press, 1989, pp. 291-396, ED: Mathews and Pierce, "Composing with Computers—a Survey of Some Compositional Formalisms and Music Programming Languages".

*Primary Examiner*—William M. Shoop, Jr.
*Assistant Examiner*—Jeffrey W. Donels
*Attorney, Agent, or Firm*—Jeffrey S. LaBaw

[57] ABSTRACT

A method and system for automatically generating an entire musical arrangement including melody and accompaniment on a computer. The invention combines predetermined, short musical phrases modified by selection of random parameters to produce a data stream that can be used to drive a MIDI synthesizer and generate music.

14 Claims, 6 Drawing Sheets

300 COMPOSITIONAL_SELECTION : = { VOICE_MATRIX | RHYTHM_MATRIX | CHORDAL_MATRIX}

310 VOICE_MATRIX = Piano, Electric Piano, Horn, Flute, Strings . . .

320 RHYTHM_MATRIX = {Style = Country, Light Rock, Latin, . . .
| Tempo = 60, 65, 70, 75, . . . (units = beats per minute) }

360 CHORDAL_MATRIX = A(major), A(major)B(major), A(major)A(minor),
A(major)B(minor)a(major), . . .

350 MELODIC_MATRIX = 1, 2, 3, 4, . . . (units = musical half tones)

340 MIDI_DATA (Select Instrument Voice) = Instrument Voice Selection Number

330 MIDI_DATA (Musical Note) = MIDI_CHANNEL, MIDI_NOTE, MIDI_ VELOCITY

FIG. 3

MELODY COMPOSER AND ARRANGER

FIELD OF THE INVENTION

This invention generally relates to improvements in computer based multimedia systems and more particularly to a system and method for automatically creating music.

BACKGROUND OF THE INVENTION

Automatic creation of music by a computer is a brand new field that has only recently come of age. The popular "Band in the Box" by PG Music is an example of computer based music generation directed to the generation of a musical accompaniment (without melody) from the knowledge of a song's chord structure. U.S. Pat. No. 4,399,731 discloses a method and system for generating simple melodies and rhythms for music education. The computer selects notes and rhythms randomly but constrained by specific musical rules to provide some degree of music. This technique is called algorithmic composition and is effective in creating very "novel" music due to a high degree of randomness.

U.S. Pat. No. 4,483,230 discloses a method for generating simple musical melodies for use as an alarm in a watch. The melody is initially defined by a user's control of musical pitch by varying the amount of light reaching the watch. The melody is saved in the watch's memory for subsequent playback as an alarm. The patent requires human intervention for defining a melody.

U.S. Pat. No. 4,708,046 discloses a method for generating simple musical accompaniments for use in an electronic musical keyboard. The accompaniment is derived from pre-stored forms with a degree of randomness that is triggered by the performer's selection of bass notes. The lowest pitch determines the key of the accompaniment and the selection of notes determines the chordal structure. The randomness allows the arrangement to have some variation in playback. Thus, this patent only provides an accompaniment to a person's performance on a musical keyboard.

SUMMARY OF THE INVENTION

Accordingly, it is a primary object of the present invention to provide a system and method for automatically generating an entire musical arrangement including melody and accompaniment on a computer.

These and other objects of the present invention are accomplished by combining predetermined, short musical phrases modified by selection of random parameters to produce a data stream that can be used to drive, for example, a synthesizer and generate music.

BRIEF DESCRIPTION OF THE DRAWINGS

FIG. 3 is a data structure in accordance with the subject invention;

DETAILED DESCRIPTION OF THE INVENTION

Figure 1A:
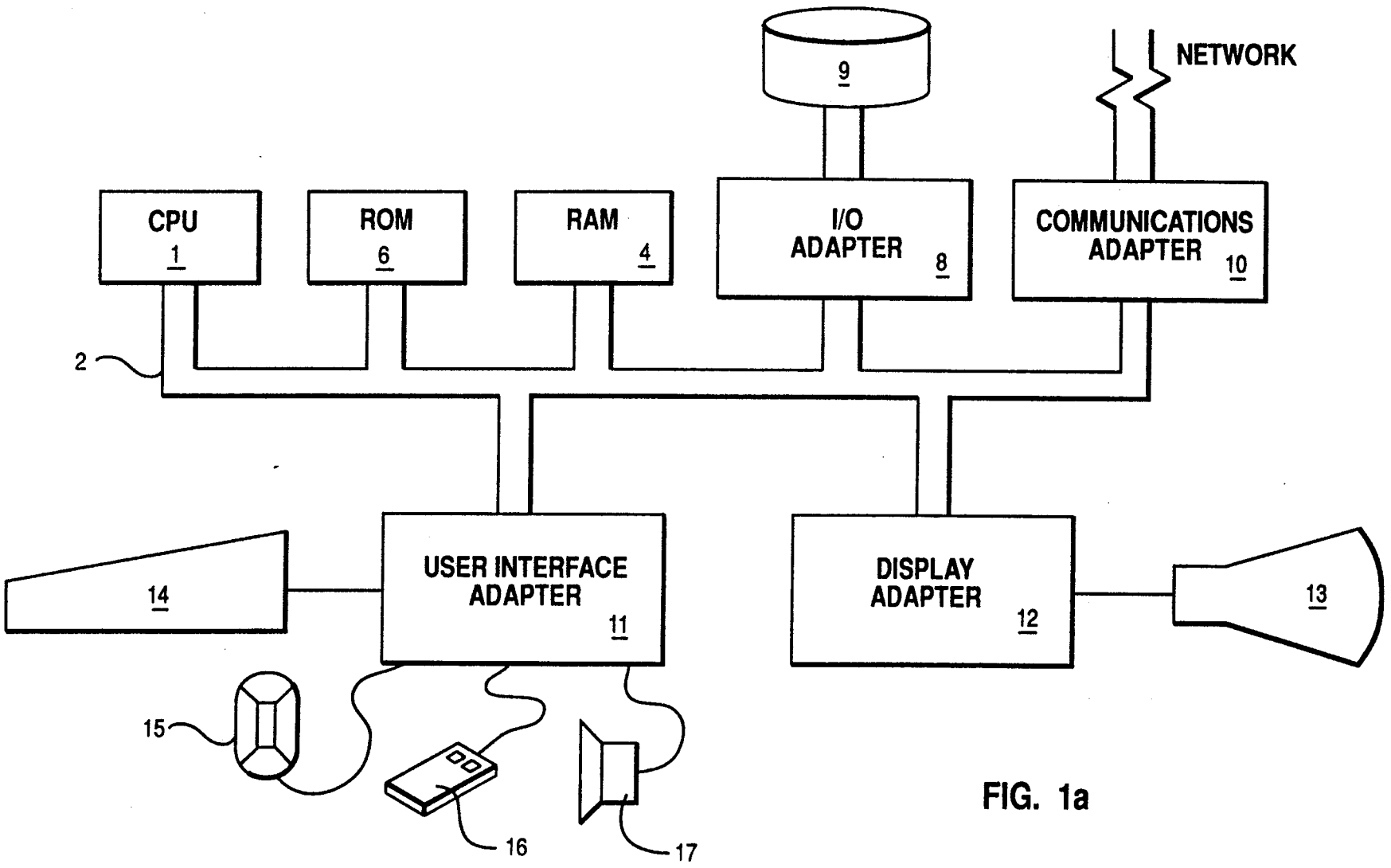
FIG. 1*a* is a block diagram of a personal computer system in accordance with the subject invention.

The invention is preferably practiced in a representative hardware environment as depicted in FIG. 1*a*, which illustrates a typical hardware configuration of a workstation in accordance with the subject invention having a central processing unit 1, such as a conventional microprocessor, and a number of other units interconnected via a system bus 2. The workstation shown in FIG. 1*a* includes a Random Access Memory (RAM) 4, Read Only Memory (ROM) 6, an I/O adapter 8 for connecting peripheral devices such as disk units 9 or a MIDI synthesizer to the bus, a user interface adapter 11 for connecting a keyboard 14, a mouse 15, a speaker 17 and/or other user interface devices to the bus, a communication adapter 10 for connecting the workstation to a data processing network or an external music synthesizer and a display adapter 12 for connecting the bus to a display device 13.

Sound processing must be done on an auxiliary processor. A likely choice for this task is to use a Digital Signal Processor (DSP) in the audio subsystem of the computer as set forth in FIG. 1*b*. The figure includes some of the Technical Information that accompanies the M-Audio Capture and Playback Adapter announced and shipped on Sep. 18, 1990 by IBM. Our invention enhances the original audio capability that accompanied the card.

Figure 1B:
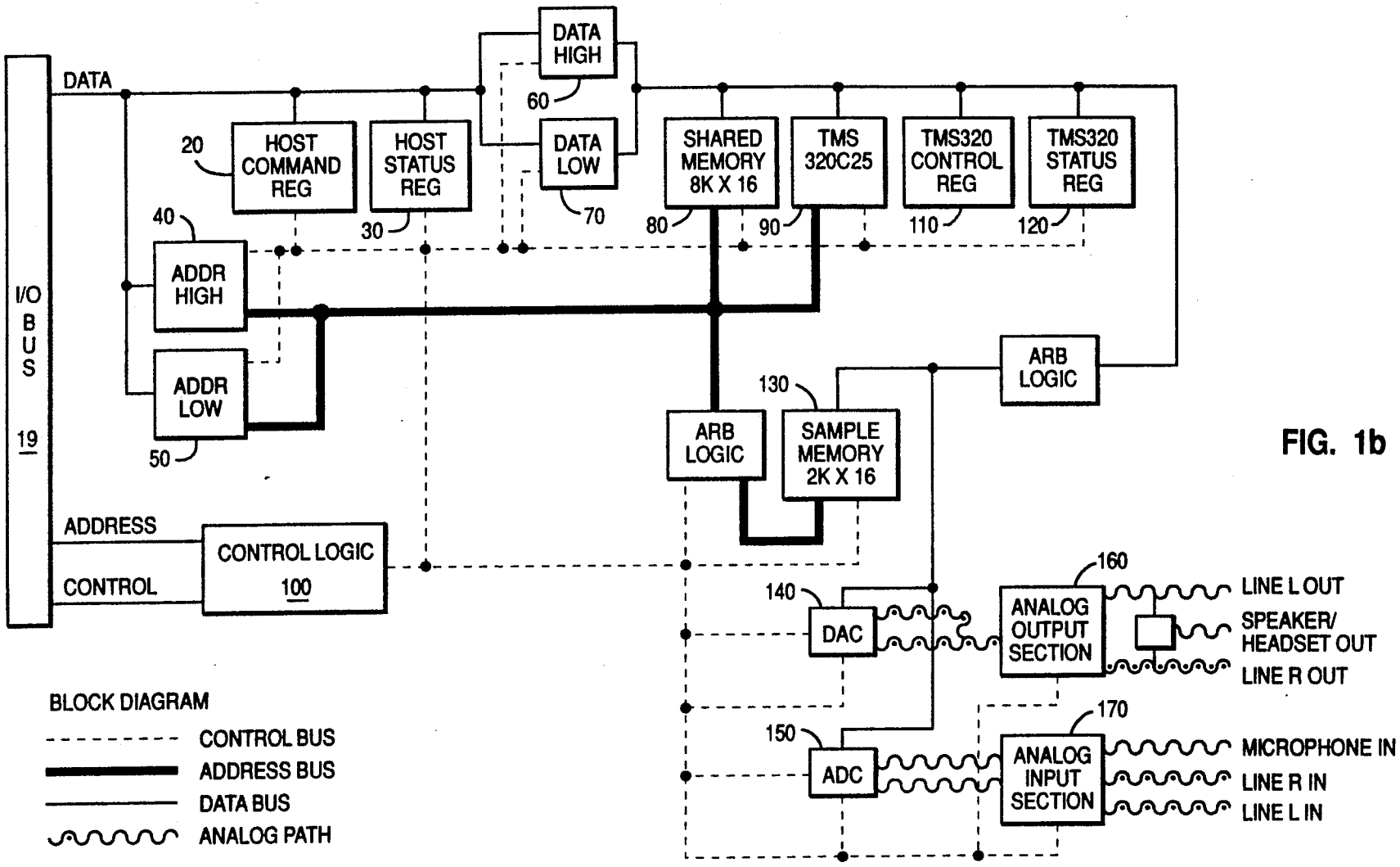
FIG. 1*b* is a block diagram of an audio capture and playback apparatus in accordance with the subject invention.

Referring to FIG. 1*b*, the I/O Bus 19 is a Micro Channel or PC I/O bus which allows the audio subsystem to communicate to a PS/2 or other PC computer. Using the I/O bus, the host computer passes information to the audio subsystem employing a command register 20, status register 30, address high byte counter 40, address low byte counter 50, data high byte bidirectional latch 60, and a data low byte bidirectional latch 70.

The host command and host status registers are used by the host to issue commands and monitor the status of the audio subsystem. The address and data latches are used by the host to access the shared memory 80 which is an 8K×16 bit fast static RAM on the audio subsystem. The shared memory 80 is the means for communication between the host (personal computer/PS/2) and the Digital Signal Processor (DSP) 90. This memory is shared in the sense that both the host computer and the DSP 90 can access it.

A memory arbiter, part of the control logic 100, prevents the host and the DSP from accessing the memory at the same time. The shared memory 80 can be divided so that part of the information is logic used to control the DSP 90. The DSP 90 has its own control registers 110 and status registers 120 for issuing commands and monitoring the status of other parts of the audio subsystem.

The audio subsystem contains another block of RAM referred to as the sample memory 130. The sample memory 130 is 2K×16 bits static RAM which the DSP uses for outgoing sample signals to be played and incoming sample signals of digitized audio for transfer to the host computer for storage. The Digital to Analog Converter (DAC) 140 and the Analog to Digital Converter (ADC) 150 are interfaces between the digital world of the host computer and the audio subsystem and the analog world of sound. The DAC 140 gets digital samples from the sample memory 130, converts these samples to analog signals, and gives these signals to the analog output section 160. The analog output section 160 conditions and sends the signals to the output connectors for transmission via speakers or headsets to the ears of a listener. The DAC 140 is multiplexed to give continuous operations to both outputs.

The ADC 150 is the counterpart of the DAC 140. The ADC 150 gets analog signals from the analog input section (which received these signals from the input connectors (microphone, stereo player, mixer. . . )), converts these analog signals to digital samples, and stores them in the sample memory 130. The control logic 100 is a block of logic which among other tasks issues interrupts to the host computer after a DSP interrupt request, controls the input selection switch, and issues read, write, and enable strobes to the various latches and the Sample and Shared Memory.

For an overview of what the audio subsystem is doing, let's consider how an analog signal is sampled and stored. The host computer informs the DSP 90 through the I/O Bus 19 that the audio adapter should digitize an analog signal. The DSP 90 uses its control registers 110 to enable the ADC 150. The ADC 150 digitizes the incoming signal and places the samples in the sample memory 130. The DSP 90 gets the samples from the sample memory 130 and transfers them to the shared memory 80. The DSP 90 then informs the host computer via the I/O bus 19 that digital samples are ready for the host to read. The host gets these samples over the I/O bus 19 and stores them it the host computer RAM or disk.

Many other events are occurring behind the scenes. The control logic 100 prevents the host computer and the DSP 90 from accessing the shared memory 80 at the same time. The control logic 100 also prevents the DSP 90 and the DAC 140 from accessing the sample memory 130 at the same time, controls the sampling of the analog signal, and performs other functions. The scenario described above is a continuous operation. While the host computer is reading digital samples from the shared memory 80, the DAC 140 is putting new data in the sample memory 130, and the DSP 90 is transferring data from the sample memory 130 to the shared memory 80.

Playing back the digitized audio works in generally the same way. The host computer informs the DSP 90 that the audio subsystem should play back digitized data. In the subject invention, the host computer gets code for controlling the DSP 90 and digital audio samples from its memory or disk and transfers them to the shared memory 80 through the I/O bus 19. The DSP 90, under the control of the code, takes the samples, converts the samples to integer representations of logarithmically scaled values under the control of the code, and places them in the sample memory 130. The DSP 90 then activates the DAC 140 which converts the digitized samples into audio signals. The audio play circuitry conditions the audio signals and places them on the output connectors. The playing back is also a continuous operation.

During continuous record and playback, while the DAC 140 and ADC 150 are both operating, the DSP 90 transfers samples back and forth between sample and shared memory, and the host computer transfers samples back and forth over the I/O bus 19. Thus, the audio subsystem has the ability to play and record different sounds simultaneously. The reason that the host computer cannot access the sample memory 130 directly, rather than having the DSP 90 transfer the digitized data, is that the DSP 90 is processing the data before storing it in the sample memory 130. One aspect of the DSP processing is to convert the linear, integer representations of the sound information into logarithmically scaled, integer representation of the sound information for input to the DAC 140 for conversion into a true analog sound signal.

The invention is a method and system for a computer based multimedia system. Music must be available in various styles to satisfy the tastes of a targeted audience. For example, a kiosk in a business mall may use a multimedia system to advertise specific products and need background music as part of the presentation. Thus, an invention, such as ours, which provides a generalized approach to creating original music in a computer has broad appeal.

A computer based multimedia music system may be realized in waveform and Music Instrument Digital Interface (MIDI) form. Waveform is an audio sampling process whereby analog audio is converted into a digital representation that is stored within a computer memory or disk. For playback, the digital data is converted back into an analog audio form that is a close representation of the original signal. Waveform requires a large amount of information to accurately represent audio which makes it a less efficient medium for a computer to employ for the creation of original music.

MIDI is a music encoding process that conforms to a widely accepted standard. MIDI data represents musical events such as the occurrence of a specific musical note realized by a specific musical sound (e.g. piano, horn or drum). The MIDI data is transformed into an audio signal via a MIDI controlled synthesizer located internally in the computer or externally connected via a communication link. MIDI data is very compact and easily modified. Thus, MIDI data is employed by the subject invention.

The invention performs a random selection and manipulation of shoft, musical phrases that are processed to generate a specific MIDI sequence that is input to a MIDI synthesizer and output to an audio speaker. Since the music is randomly generated, there is no correlation to existing music and each composition is unique. By employing appropriate musical structure constraints, the resulting music appears as a cohesive composition rather than a series of random audio tones.

A work of music created by the subject invention is divided into the following characteristic parameters. Voicing refers to the selection of musical sounds for an arrangement. Style refers to the form of a musical arrangement. Melody refers to a sequence of musical notes representing a theme of the arrangement. Tempo refers to a rate of playback of an arrangement. Key refers to the overall pitch of an arrangement.

Figure 2:
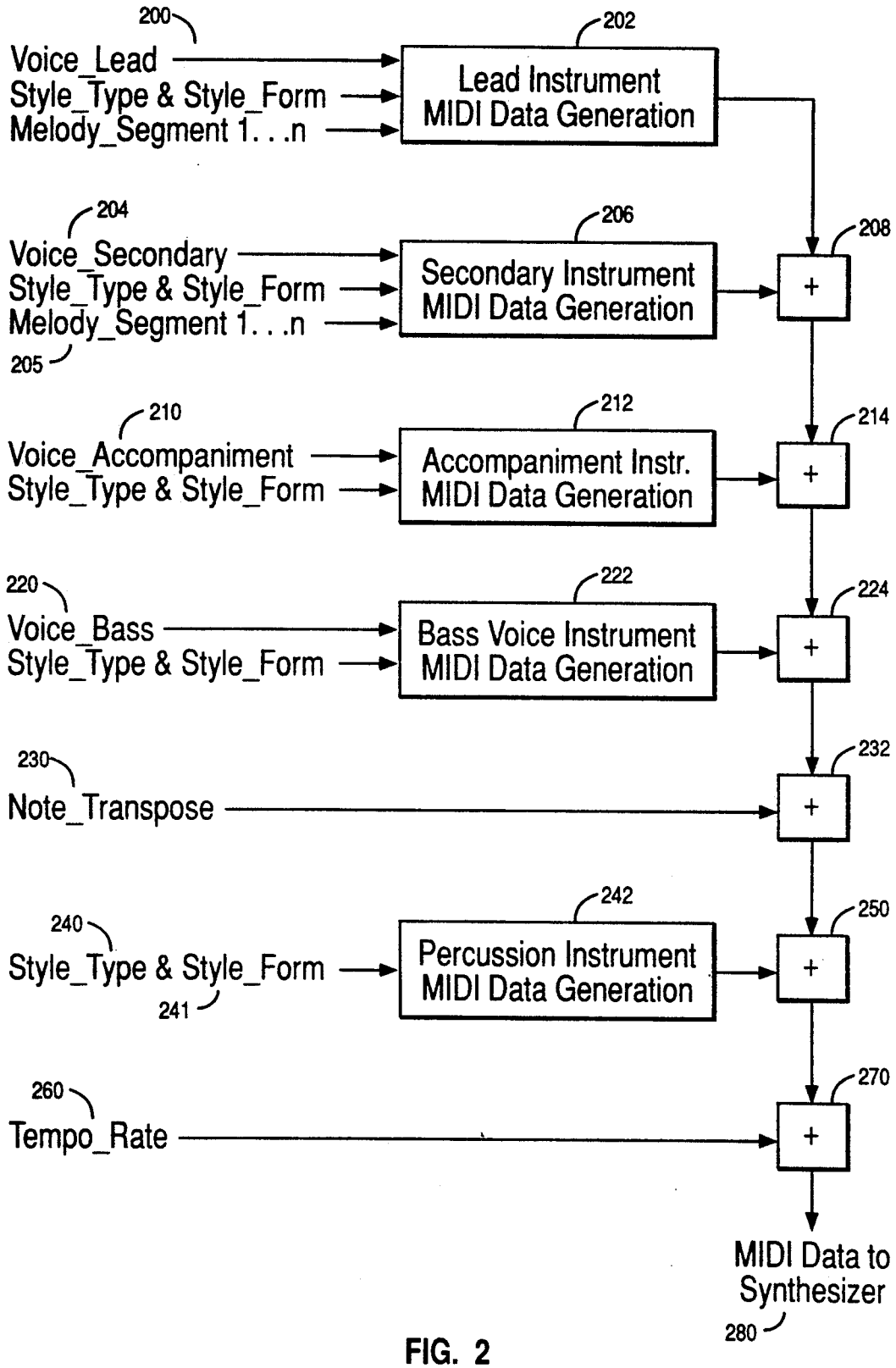
FIG. 2 illustrates a MIDI note generation process in accordance with the subject invention.

Another list of parameters govern the generation of the MIDI data input to a MIDI synthesizer as set forth in FIG. 2. Voice_Lead 200 is a random selection of MIDI data representative of a melody voice selection (e.g. piano, electric piano or strings) that is used to control the synthesizer realization of the lead melody instrument.

Voice_Second 204 is a random selection of MIDI data representing the melody voice selection (e.g. piano, electric piano, horn or flute) that is used to control the synthesizer realization of the secondary melody instrument. Voice_Second 204 must be different from Voice_Lead 200.

Voice_Accompaniment 210 is a random selection of MIDI data representing the accompaniment voice selection (e.g. piano, electric piano, strings) that is used to control the synthesizer realization of the accompaniment instrument. Voice_Accompaniment 210 must be different from Voice_Lead 200 or Voice_Second 204.

Voice_Bass 220 is a random selection of MIDI data representing the bass voice selection (e.g. acoustic bass, electric bass or fretless bass) that is used to control the synthesizer realization of the bass instrument. Style_Type 240 is a random selection of musical style types (e.g. country, light rock or latin). This selection strongly affects the perception of the realized music and may be limited to match the tastes of the targeted audience. Style_Type 240 affects the generation of MIDI note data for all instrument realizations. Style_Form 241 is a random selection of musical forms (e.g. ABA, ABAB, ABAC; major key or minor key) that determine the overall structure of the composition. For example, the element "A" may represent the primary melody as played by the Lead Voice, "B" a chorus as played by the Secondary Voice, and "C" an ending as played by both the Lead and the Secondary Voices. Style_Form 241 affects the generation of MIDI note data for all instrument realizations.

Melody_Segment 205 is a random selection of MIDI note data representing the principal notes of an arrangement. Multiple Melody_Segments are used in sequence to produce an arrangement. Tempo_Rate 260 is a random selection of MIDI data representing the tempo of an arrangement (e.g. 60 beats per minute) that is used to control the rate at which the MIDI data is sent to the synthesizer. Note_Transpose 230 is a random selection of a number used to offset all MIDI note data sent to the synthesizer to raise or lower the overall musical key (i.e. pitch) of the composition.

The invention flow is provided via FIG. 2 and executes as follows. All random parameters are selected for a given arrangement using a random number generator. Then, a MIDI voice selection data is generated to initialize the MIDI synthesizer with the appropriate voices for the realization of lead melody instruments, secondary melody instruments, accompaniment instruments, bass instruments and percussion instruments. The Lead and Secondary Instrument's MIDI data is generated from a selected sequence of Melody_Segment MIDI note data 205 modified with the selected Style_Type 240 and Style_Form 241. The Bass 220, Accompaniment 210 and Percussion Instrument's MIDI data is generated from the selected Style_Type 240 and Style_Form 241. Then, the MIDI note data for all voices except percussion is modified by Note_Transpose 230 to select the desired musical key and is transmitted to the MIDI synthesizer at the Tempo_Rate 260 to realize the music.

Detailed Implementation/Logic Data Structures

The heart of the invention is the data structure set forth in FIG. 3. The compositional_selection 300 stores the type of composition the particular information in the data structure refers to whether it be voice, rhythm or chords. If the particular selection is voice, then the voice_matrix 310 will preserve the particular type of instrument used for voice in the musical composition. If the particular selection is rhythm, then rhythm_matrix 320 will save the style and tempo of the musical composition. Finally, if the particular selection is chords, then chordal_matrix 360 will keep the chord structure of the musical composition.

Regardless of the compositional selection, the following information is also obtained for a particular composition. Melodic_Matrix 360 stores the musical half tones of a unit of music in the composition. Midi_data 350 selects the instrument voice. Midi_data 340 selects the musical note of the composition. The use of the data structure is illustrated in the flow charts which appear in FIGS. 4 and 5.

FLOW CHARTS

Figure 4:
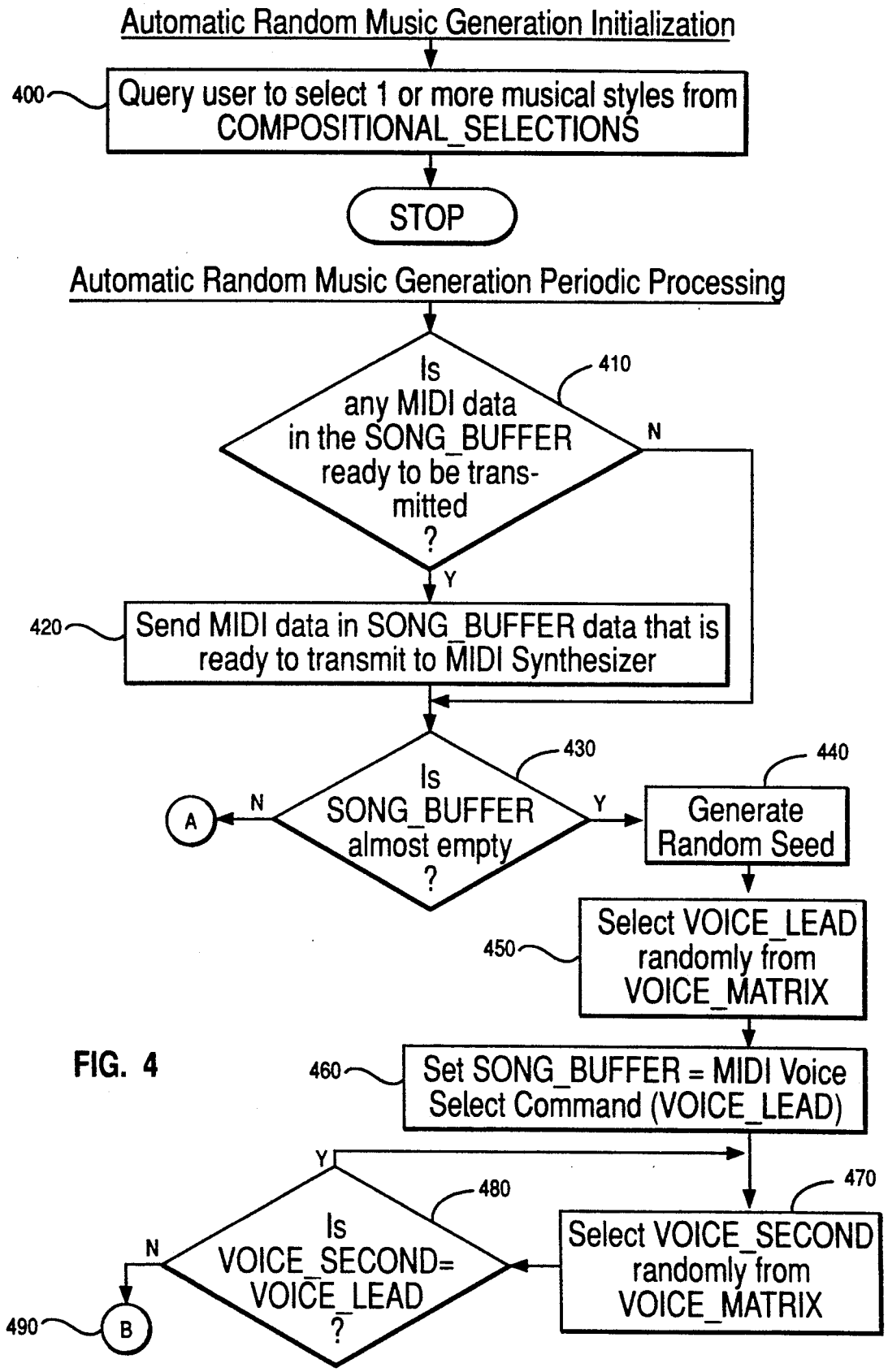
FIG. 4 is a flowchart of the music generation logic in accordance with the subject invention.
Figure 5:
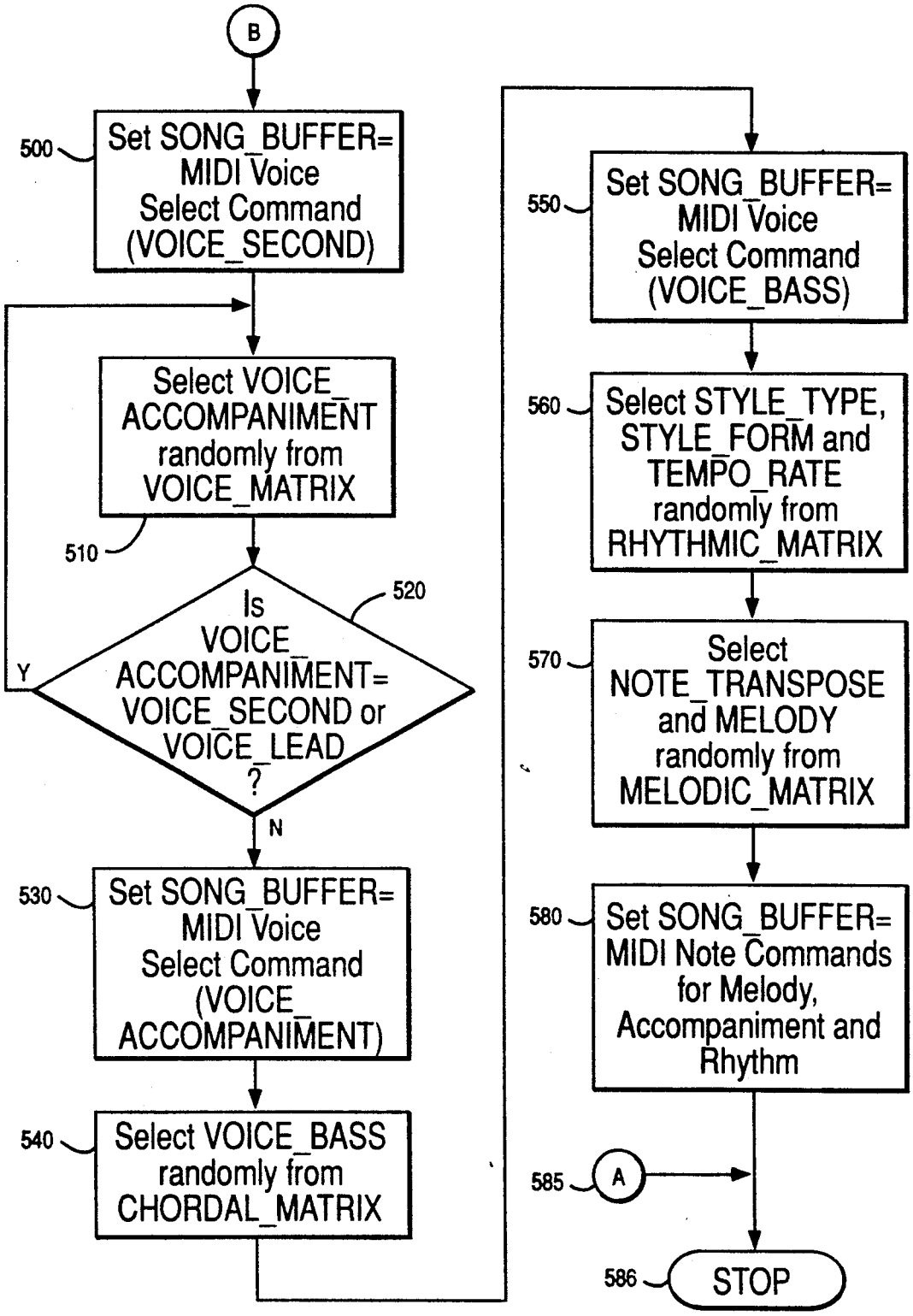
FIG. 5 is a flowchart of the music generation logic in accordance with the subject invention.

FIGS. 4 and 5 are flow charts of the detailed logic in accordance with the subject invention. Function block 400 performs initialization of the musical composition at system startup. A user is queried to determine the paricular musical requirements that are necessary. Normal processing commences at decision block 410 where a test is performed to determine if any MIDI data is ready to be transmitted. The MIDI data resides in SONG—BUFFER and is sent to a music synthesizer based on performance timing parameters stored in the system data structure. If there is data, then it is transmitted in function block 420 to a MIDI synthesizer.

A second test is performed at decision block 430 to determine if the song buffer is almost empty. If the buffer is not empty, then control passes to FIG. 5 at label 585. If it is, the a random seed is generated at function block 440 to assure that each musical composition is unique. Then, function block 450 randomly selects the lead melody instrument sound, the MIDI data corresponding to the lead melody instrument is loaded into the song buffer at function block 460 and the synthesized instrument sound for the second melody is selected at function block 470. A third test is performed at decision block 480 to insure that a different synthesized instrument is selected for the second melody part. If the same instrument was selected, then control branches back to function block 470 to select another instrument. If not, then control passes via label 490 to FIG. 5.

FIG. 5 processing commences with function block 500 where the MIDI data corresponding to the second melody part is loaded into the song buffer and the synthesized instrument sound for the accompaniment is selected at function block 510. Then a fourth test is performed at decision block 520 to assure that a different synthesized sound is selected for accompaniment. If not, then control passes to function block 510 to select another instrument for accompaniment. If a different instrument was selected, then at function block 530 the MIDI data to select the accompaniment music is loaded into the song buffer. At function block 540, the bass instrument is selected and its corresponding MIDI information is loaded into the song buffer at function block 550. Then, a specific style, form and tempo for a composition are selected at function block 560; a specific transpose and melody pattern are selected in function block 570 and finally, at function block 580, MIDI data to play the arrangement is loaded into the song buffer.

Pseudo Code of the Preferred Embodiment

The following pseudo code illustrates the algorithmic technique for creating electronic music in computer-based multimedia systems.

```
Main ( )
{
initialize random_number_generator( );
loop
/* select values for musical parameters */
chordal_root := random_number_generator( )/value;
chordal_mode := random_number_generator( )/value;
chordal_accomp := random_number_generator( )/value;
melody_seg1 := random_number_generator( )/value;
melody_seg2 := random_number_generator( )/value;
transpose := random_number_generator( )/value;
rhythm_type := random_number_generator( )/value;
rhythm_mode := random_number_generator( )/value;
tempo := random_number_generator( )/value;
instr1 := random_number_generator( )/value;
instr2 := random_number_generator( )/value;
Chordal_matrix(chordal_root,chordal_mode,chordal_
accomp);
Melodic_matrix(melody_seg1,melogy_seg2,note_trans
pose);
Rhythmic_matrix(rhythm_type,rhythm_mode,tempo);
Voice_matrix(instr1,instr2);
} /* end of main */
/*****************************************/
Procedure
Chordal_matrix(chordal_root,chordal_mode,chordal_
accomp);
array voice_bass{ } := { {I}, {I,ii,V}, {V,vi},
{iii,IV}, {V,I}, . . . };
array voice_mode{ } := {
{pentatonic intervals},{whole tone intervals},
. . . };
array voice_accompaniment{ } := {
{alberti bass patterns}, {block patterns}, . . . };
loop
{
    output(voice_bass{chordal_root},
        (voice_accompaniment{chordal_accomp},
        voice_mode{chordal_mode})):
}
/* end of Chordal_matrix */
/*****************************************/
Procedure
Melodic_matrix(melody_seg1,melody_seg2,transpose)
;
array melody1{ } := {
{1},{1,2,5},{4+,5},{1,2,2−,3−,4},{5,1,5}, . . . };
array melody2{ } := {
{1},{1,3},{5},{4,6}, . . . };
array note_transpose{ } := {
{1},{2},{3},{4},{5},{6},{7},{8},{9},{10},{11},
{12} };
loop
{
output((melody1{melody_seg1},note_transpose{trans
pose}),
(melody2{melody_seg2}, note_transpose{transpose}));
}
/*end of Melodic_matrix */
/*****************************************/
Procedure
Rhythmic_matrix(rhythm_type,rhythm_mode,tempo);
array style_form{ } := {
{1/4},{2/4},{3/4},{4/4},{1/8}, . . . };
array style_type{ } := {
{country rhythmic patterns},{latin rhythmic
patterns},{classic
rhythmic patterns}, . . . };
array tempo_rate{ } := {
{60},{65},{70},{75}, . . . };
loop
{
output(style_type{rhythm_mode};(style_form{rhythm_
type},
    tempo_rate{tempo}));
}
/* end of Rhythmic_matrix */
/*****************************************/
Procedure Voice_matrix(instr1,instr2);
array voice_lead{ } := {
{piano1,piano2},{tuba,horn}, . . . };
array voice_second{ } := {
```

-continued

```
{drums},{timpani}, . . . };
loop
{
output(voice_lead{instr1},voice_second{instr2});
}
/* end of Voice_matrix */
/*****************************************/
/* end of pseudo code  */
```

While the invention has been described in terms of a preferred embodiment in a specific system environment, those skilled in the art recognize that the invention can be practiced, with modification, in other and different hardware and software environments within the spirit and scope of the appended claims.

Having thus described our invention, what we claim as new, and desire to secure by Letters Patent is:

1. An apparatus for generating music comprising:

a memory for storing a plurality of musical phrases each containing a plurality of musical pitches and data representing a plurality of musical instruments a processor coupled to the memory;

a random number generator coupled to the processor:

melody generating means coupled to the processor for generating a melody by selecting a sequence of musical phrases from the plurality of stored musical phrases according to at least a first random number;

accompaniment generating means coupled to the processor generating an accompaniment with the melody and, instrument selection means for selecting a first musical instrument for the melody according to a second random number and second musical instrument for the accompaniment according to a third random number.

wherein the melody, accompaniment and first and second musical synthesizer to produce an audio signal.

2. The apparatus as recited in claim 1 wherein the melody generating means generates a second melody by selecting musical phrases from the plurality of musical phrases according to at least a fourth random number and the instrument selection means selects a third musical instrument for the second melody according to a fifth random number.

3. The apparatus as recited in claim 1 wherein the instrument selection means further comprises a means to insure that none of the musical instruments are identical.

4. The apparatus as recited in claim 1 which further comprises style selection means for selecting a style according to a random number.

5. The apparatus as recited in claim 1 which further comprises tempo selection means for selecting a tempo according to a random number.

6. The apparatus as recited in claim 1 which further comprises transposition means for transposing the melody to a selected key.

7. A method for generating music in a data processing system having a memory for storing a plurality of musical phrases each containing a plurality of musical pitches and data representing a plurality of musical, instruments a processor coupled to the memory and a random number generator coupled to the processor, the method comprising the steps of:

generating a melody by selecting a sequence of musical phrases from the plurality of musical phrases according to at least a first random number;

generating an accompaniment with the melody;

selecting a first musical instrument for the melody according to a second random number and second musical instrument for the accompaniment according to a third random number wherein the melody, accompaniment and first and second musical are; represented; and, sending the synthesizer to produce an audio signal.

8. The method as recited in claim 7 which further comprises the steps of generating a second melody by selecting musical phrases from the plurality of musical phrases according to at least a fourth random number and selecting a third musical instrument for the second melody according to a fifth random number.

9. The method as recited in claim 7 further comprises the step of insuring that none of the musical instruments are identical.

10. The method as recited in claim 7 which further comprises the step of selecting a style according to a random number.

11. The method as recited in claim 7 which further comprises the step of selecting a tempo according to a random number.

12. The method as recited in claim 7 which further comprises the step of generating a key to which the melody will transposed.

13. An apparatus for generating music comprising:

melody generating means for generating a melody by selecting a sequence of musical phrases each containing a plurality of musical pitches from a plurality of musical phrases stored in a computer memory according to at least a first random number;

accompaniment generating means for generating an accompaniment with the melody; and, instrument selection means for selecting a first musical instrument for the melody according to a second random number and a second musical instrument for the accompaniment according to a third random number.

14. A method for generating music comprising the steps of:

generating a melody by selecting from a computer memory a sequence of musical phrases from a plurality of musical phrases each containing a plurality of musical pitches according to at least a first random number;

generating an accompaniment with the melody;

selecting a first musical instrument for the melody according to a second random number and second musical instrument for the accompaniment according to a third random number.

* * * * *